US011768005B2

(12) United States Patent
Shinozaki

(10) Patent No.: US 11,768,005 B2
(45) Date of Patent: Sep. 26, 2023

(54) AIR-CONDITIONING SYSTEM AND ZONAL AIR-CONDITIONING CONTROL METHOD

(71) Applicant: Mitsubishi Electric Corporation, Tokyo (JP)

(72) Inventor: Kazuyoshi Shinozaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 905 days.

(21) Appl. No.: 16/617,670

(22) PCT Filed: Jul. 31, 2017

(86) PCT No.: PCT/JP2017/027599
§ 371 (c)(1),
(2) Date: Nov. 27, 2019

(87) PCT Pub. No.: WO2019/026098
PCT Pub. Date: Feb. 7, 2019

(65) Prior Publication Data

US 2020/0182505 A1 Jun. 11, 2020

(51) Int. Cl.
*F24F 11/46* (2018.01)
*F24F 11/80* (2018.01)
(Continued)

(52) U.S. Cl.
CPC ..... *F24F 11/80* (2018.01); *F24F 11/46* (2018.01); *F24F 11/64* (2018.01); *F24F 2110/10* (2018.01); *F24F 2120/10* (2018.01)

(58) Field of Classification Search
CPC .. F24F 11/80; F24F 11/46; F24F 11/64; F24F 2110/10; F24F 2120/10; F24F 11/83; F24F 11/89; F24F 3/065; F24F 2120/12
See application file for complete search history.

(56) References Cited

U.S. PATENT DOCUMENTS

2015/0013958 A1* 1/2015 Kubo ..... F24F 11/63 165/250

FOREIGN PATENT DOCUMENTS

EP 2 357 419 A2 8/2011
EP 2 357 420 A2 8/2011
(Continued)

OTHER PUBLICATIONS

International Search Report of the International Searching Authority dated Sep. 19, 2017 for the corresponding international application No. PCT/JP2017/027599 (and English translation).
(Continued)

*Primary Examiner* — Christopher E. Everett
*Assistant Examiner* — Marzia T Monty
(74) *Attorney, Agent, or Firm* — POSZ LAW GROUP, PLC

(57) ABSTRACT

In an air-conditioning system that divides a room to be air-conditioned into a plurality of areas and controls air-conditioning of each of the plurality of areas, a set temperature of an occupied area in which somebody is present is determined as a target temperature of the occupied area. Target temperatures of unoccupied areas in which nobody is present are determined such that the air-conditioning mode set for the occupied area weakens stepwise from an adjacent area located next to the occupied area toward a distal area located farthest from the occupied area.

10 Claims, 8 Drawing Sheets

(51) Int. Cl.

| | |
|---|---|
| ***F24F 11/64*** | (2018.01) |
| *F24F 120/10* | (2018.01) |
| *F24F 110/10* | (2018.01) |

(56) References Cited

FOREIGN PATENT DOCUMENTS

| | | | |
|---|---|---|---|
| JP | H11-311437 | A | 11/1999 |
| JP | 2006-125727 | A | 5/2006 |
| JP | 2009-299933 | A | 12/2009 |

OTHER PUBLICATIONS

Office Action dated Sep. 7, 2022 issued in corresponding DE Patent Application No. 112017007798.2 (and English translation).

* cited by examiner

| DISTANCE FROM OCCUPIED AREA (ROOM TEMPERATURE SENSOR) (m) | 0 | 5 | 10 | 15 | 20 | 25 | 30 |
|---|---|---|---|---|---|---|---|
| DIFFERENCE BETWEEN SET TEMPERATURE OF OCCUPIED AREA AND TARGET TEMPERATURE (°C) | 0 | ±0.5 | ±1.0 | ±1.5 | ±2.0 | ±2.5 | ±3.0 |

TARGET TEMPERATURE TABLE

AIR-CONDITIONING SYSTEM AND ZONAL AIR-CONDITIONING CONTROL METHOD

CROSS REFERENCE TO RELATED APPLICATION

This application is a U.S. national stage application of PCT/JP2017/027599 filed on Jul. 31, 2017, the contents of which are incorporated herein by reference.

TECHNICAL FIELD

The present invention relates to an air-conditioning system and a zonal air-conditioning control method that air-condition a room in which plural indoor units are installed.

BACKGROUND ART

Conventionally, in an office building, large-scale commercial facilities, or other similar facilities, a room is divided into plural areas and room temperature is controlled on an area by area basis. Patent Literature 1 proposes an air-conditioning device that can vary operating capacity of an indoor unit depending on whether anybody is present in the area where the indoor unit is located, to achieve energy savings.

CITATION LIST

Patent Literature

Patent Literature 1: Japanese Unexamined Patent Application Publication No. 11-311437

SUMMARY OF INVENTION

Technical Problem

The air-conditioning device described in Patent Literature 1 reduces operating capacity in an unoccupied area adjacent to an occupied area and stops operation of an indoor unit in an unoccupied area on an outer side of the unoccupied area adjacent to the occupied area. If an area in which an indoor unit is operating and an area in which an indoor unit is not operating coexist in the same room, the air conditioned by the indoor unit in the occupied area flows from the occupied area to the unoccupied area in which an indoor unit is not operating. That is, when cooling operation is being performed in the occupied area, cold air flows to the unoccupied area, and when heating operation is being performed, warm air flows to the unoccupied area. This might impair comfort of air-conditioning in the occupied area. Also, if one attempts to ensure comfort by keeping the room temperature of an occupied area at a set temperature to prevent diffusion of air into an area in which an indoor unit is not operating, it becomes necessary to increase the operating capacity of an indoor unit, making it difficult to achieve energy savings.

The present invention has been made to solve the above problem and has an object to provide such an air-conditioning system and zonal air-conditioning control method for a room in which plural indoor units are installed that ensure comfort and energy efficiency.

Solution to Problem

According to one embodiment of the present invention, there is provided an air-conditioning system that divides a room to be air-conditioned into a plurality of areas and controls air-conditioning of each of the plurality of areas, the air-conditioning system comprising: a plurality of presence/absence detection units provided in respective ones of the plurality of areas and adapted to detect whether or not anyone is present in the respective areas; a plurality of temperature detection units provided in respective ones of the plurality of areas and adapted to detect respective room temperatures; a plurality of indoor units provided in respective ones of the plurality of areas; and a controller adapted to control the plurality of indoor units based on detection results produced by the plurality of presence/absence detection units and detection results produced by the plurality of temperature detection units, wherein the controller includes: a presence/absence map creation unit adapted to create a presence/absence map showing a relative positional relationship between an occupied area in which somebody is present and unoccupied areas in which nobody is present, based on the detection results produced by the plurality of presence/absence detection units, a target temperature determination unit adapted to determine target temperatures of the respective room temperatures of the occupied area and the unoccupied areas based on the presence/absence map created by the presence/absence map creation unit, and a control unit adapted to control the respective indoor units of the occupied area and the unoccupied areas such that the respective room temperatures of the occupied area and the unoccupied areas conform to the target temperatures determined by the target temperature determination unit, and the target temperature determination unit designates a temperature set for a set air-conditioning mode as the target temperature of the occupied area, and determines the target temperatures of the unoccupied areas such that the air-conditioning mode set for the occupied area weakens stepwise from an adjacent area located next to the occupied area toward a distal area located farthest from the occupied area in the room.

Also, according to another embodiment of the present invention, there is provided a zonal air-conditioning control method that divides a room to be air-conditioned into a plurality of areas, allocates, in the plurality of areas, respective presence/absence detection units adapted to detect whether or not anyone is present, respective temperature detection units adapted to detect room temperatures, and respective indoor units, and controls air-conditioning of the plurality of areas based on detection results produced by the presence/absence detection units and the temperature detection units, the zonal air-conditioning control method comprising: a presence/absence information acquisition step of acquiring respective pieces of information on human presence/absence in the plurality of areas based on the detection results produced by the presence/absence detection units, a presence/absence map creation step of creating a presence/absence map showing a relative positional relationship between an occupied area in which somebody is present and unoccupied areas in which nobody is present, based on the presence/absence information acquired in the presence/absence information acquisition step and a relative positional relationship between the presence/absence detection units and the temperature detection units in the room, a target temperature determination step of determining target temperatures of room temperatures of the occupied area and the unoccupied areas based on the presence/absence map created in the presence/absence map creation step, and an operation step of operating the indoor units of the occupied area and the unoccupied areas such that the room temperatures conform to the target temperatures determined in the target temperature determination step, wherein in the target temperature determination step, a temperature set for the occupied area is designated as the target temperature of the occupied area, and the target temperatures of the unoccupied areas are determined such that an air-conditioning mode set for the occupied area weakens stepwise from an adjacent area located next to the occupied area toward a distal area located farthest from the occupied area in the room.

Advantageous Effects of Invention

According to the embodiments of the present invention, the air-conditioning system and zonal air-conditioning control method that air-condition a room in which plural indoor units are installed can achieve energy savings as a whole while maintaining comfort of areas in which persons are present.

DESCRIPTION OF EMBODIMENTS

Embodiments of an air-conditioning system according to the present invention will be described in detail below with reference to the drawings. Note that the present invention is not limited by the embodiments described below. Also, in the following drawings, components may not be shown in their true size relations.

Embodiment 1

Figure 1:
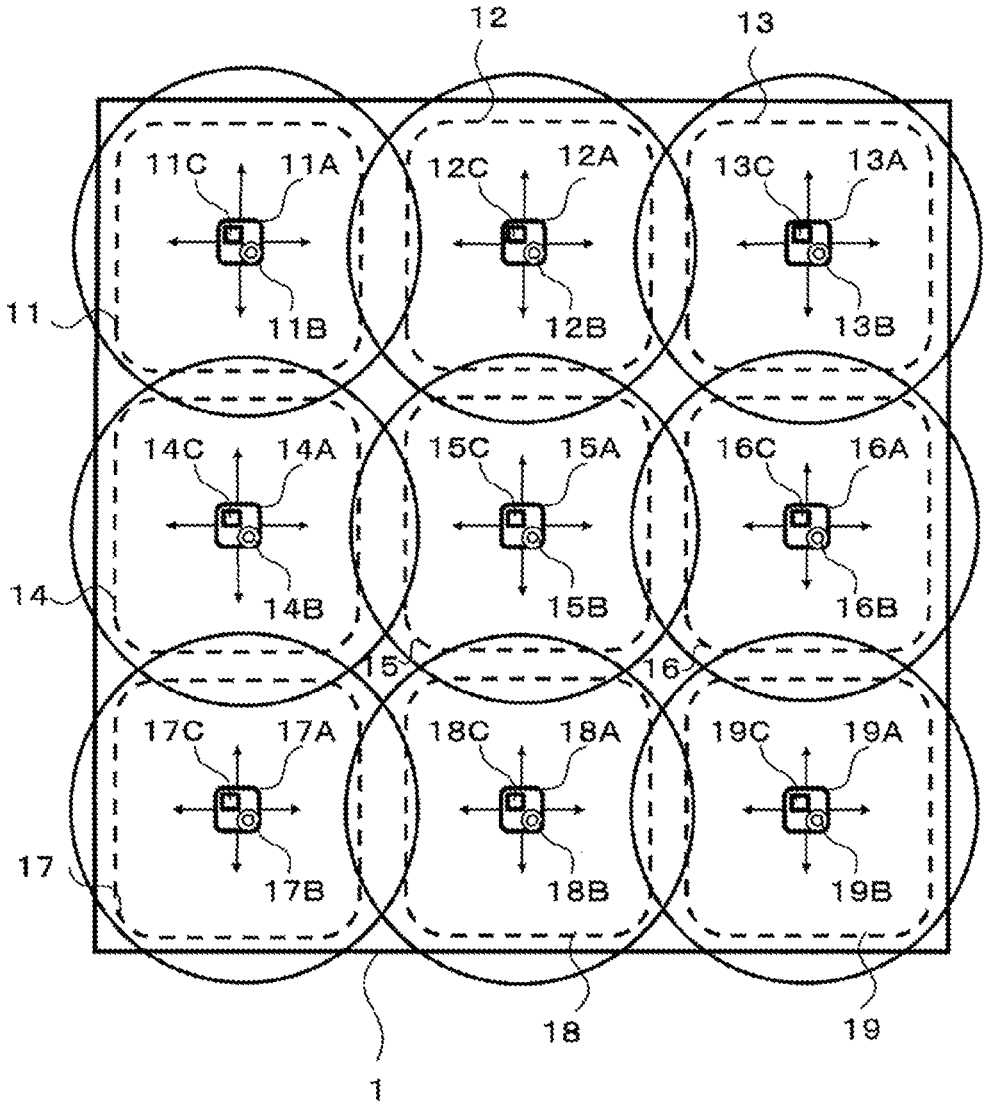
FIG. 1 is a plan view schematically showing a room into which an air-conditioning system according to Embodiment 1 of the present invention has been introduced.

FIG. 1 is a plan view schematically showing a room into which an air-conditioning system according to Embodiment 1 of the present invention has been introduced. A rectangular room 1 to be air-conditioned is divided into nine areas in total. In FIG. 1, the nine areas are indicated by dotted lines by being arranged in an array of three horizontal rows and three vertical columns. In FIG. 1, the uppermost three areas are denoted as areas 11, 12, and 13, respectively, from left to right. Three areas adjoining the areas 11, 12, and 13, respectively, are denoted as areas 14, 15, and 16, respectively, from left to right. In FIG. 1, the lowermost three areas are denoted as areas 17, 18, and 19, respectively, from left to right.

An indoor unit, presence sensor, and infrared sensor are placed in each of the areas 11 to 19. In FIG. 1, the indoor units, presence sensors, and infrared sensors are denoted by respective area numbers followed by a capital A, capital B, and capital C, respectively. For example, the indoor unit 11A, presence sensor 11B, and infrared sensor 11C are placed in the area 11 and the indoor unit 16A, presence sensor 16B, and infrared sensor 16C are placed in the area 16. In FIG. 1, coverages of the presence sensors 11B to 19B are indicated by respective solid circles.

The indoor units 11A to 19A, of which outlet directions of conditioned air are indicated by arrows, are four-way airflow ceiling concealed indoor units from which air blows out in four directions. The presence sensors 11B to 19B and infrared sensors 11C to 19C are mounted on the corresponding indoor units 11A to 19A. The presence sensors 11B to 19B, which are intended to detect whether or not anyone is present in the respective areas 11 to 19, correspond to presence/absence detection units of the present invention. The infrared sensors 110 to 19C which are intended to detect room temperatures of the respective areas 11 to 19, correspond to temperature detection units of the present invention.

Figure 2:
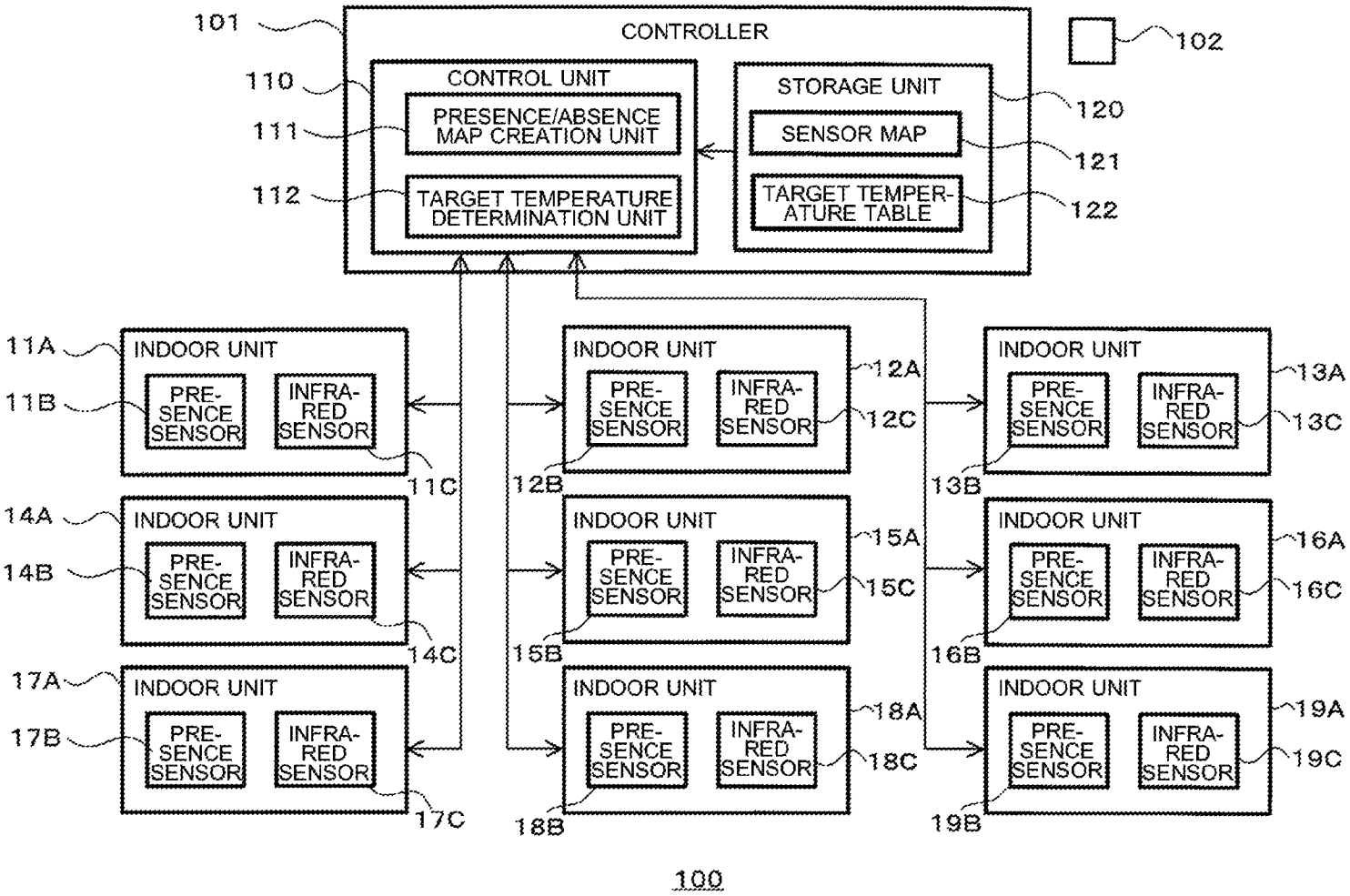
FIG. 2 is a functional block diagram of the air-conditioning system according to Embodiment 1 of the present invention.

FIG. 2 is a functional block diagram of the air-conditioning system according to Embodiment 1 of the present invention. The air-conditioning system 100 includes a controller 101, a remote control 102, the indoor units 11A to 19A, the presence sensors 11B to 19B, and the infrared sensors 11C to 19C. The controller 101 generally controls the air-conditioning system 100 and includes a microcomputer equipped with a CPU, a storage unit described later, and an I/O port. Also, the controller 101 is connected with input units such as a mouse and keyboard as well as display units such as a display and touch panel. Also, the controller 101 exchanges data with the remote control 102. The exchanged data includes data that indicates whether an energy-saving mode is enabled or disabled. Here, the energy-saving mode involves controlling operating capacity of the indoor units 11A to 19A in areas in which nobody is present and thereby reducing energy consumption. By operating the remote control 102, the user can switch between an enabled state and disabled state of the energy-saving mode.

The controller 101 includes a control unit 110 and a storage unit 120. The controller 101 is connected with the indoor units 11A to 19A, presence sensors 11B to 19B, and infrared sensors 11C to 19C. The control unit 110 accepts, as input, information on human presence/absence in the areas 11 to 19 detected by the presence sensors 11B to 19C and room temperature information on the areas 11 to 19 detected by the infrared sensors 110 to 19C.

Figures 3, 4:
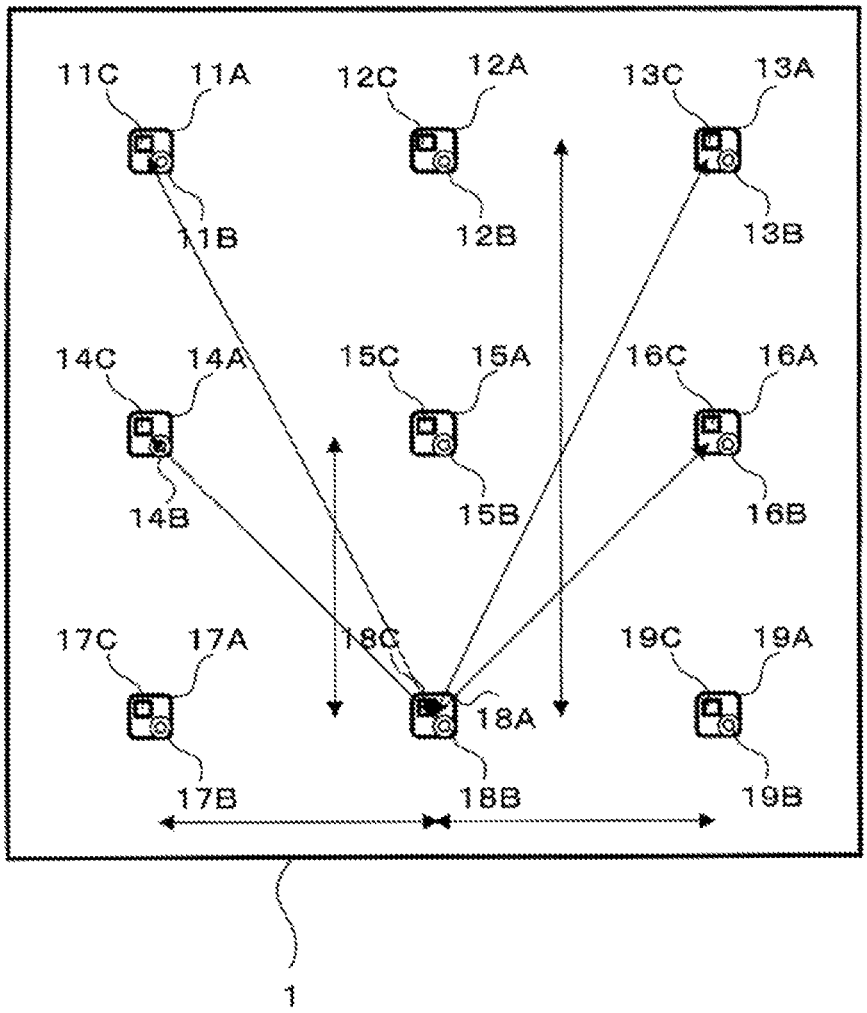
FIG. 3 is a conceptual diagram of a sensor map.
FIG. 4 is a diagram showing a target temperature table.

The storage unit 120 stores a sensor map 121 and target temperature table 122. FIG. 3 is a conceptual diagram of a sensor map. The sensor map 121 contains information about a relative positional relationship among the presence sensors 11B to 19B and infrared sensors 110 to 19C in the room 1. For example, in the case of the area 18, as schematically indicated by arrows in FIG. 3, the sensor map 121 contains information about distances and directions to the presence sensors 11B to 16B, 17B, and 19B from the presence sensor 18B. The sensor map 121 also contains information about distances and directions to the infrared sensors 110 to 16C, 17C, and 19C from the infrared sensor 18C. Similarly, the sensor map 121 also contains information about sensor-to-sensor distances and sensor-to-sensor directions from each of the remaining presence sensors and from each of the remaining infrared sensors.

The sensor map 121 is created at the time of a trial run after the indoor units 11A to 19A are installed in the room 1. The sensor map 121 may be created by an operator in charge of the trial run of the indoor units 11A to 19A by manually entering data on the areas 11 to 19 and indoor units 11A to 19A. Alternatively, the sensor map 121 may be created using video recognition by the infrared sensors 11C to 19C. For example, the relative positional relationship among the infrared sensors 11C to 19C may be grasped through recognition of the same video. Alternatively, by temporarily installing a heat source in a common coverage in the room 1, the relative positional relationship among the infrared sensors 11C to 19C may be grasped based on a temperature distribution in detection video.

FIG. 4 is a diagram showing a target temperature table. The target temperature table 122 is used to determine a target temperature of the room temperature of any unoccupied area in which nobody is present, out of the areas 11 to 19. The target temperature table 122 stores distances from an occupied area to unoccupied areas as well as differences between a set temperature of the occupied area and target temperatures of the unoccupied areas by associating the distances and differences with each other. The upper row of the target temperature table 122 contains the distances (in meters) from the occupied area to the unoccupied areas. The lower row contains the differences (in degrees C.) between the set temperature of the occupied area and the target temperatures of the unoccupied areas. The difference between the target temperatures of the unoccupied areas and the set temperature of the occupied area is defined such that an air-conditioning mode of the occupied area will weaken stepwise with increasing distance from the occupied area. The plus sign in front of the numeric values in the lower row of the target temperature table 122 indicates that the target temperatures of the unoccupied areas are made higher than the set temperature of the occupied area when the air-conditioning mode of the occupied area is cooling operation. The minus sign in front of the numeric values in the lower row of the target temperature table 122 indicates that the target temperatures of the unoccupied areas are made lower than the set temperature of the occupied area when the air-conditioning mode of the occupied area is heating operation.

For example, when the air-conditioning mode of the occupied area is cooling operation and an unoccupied area is located at a distance of 5 m from the occupied area, the target temperatures of the unoccupied area is set 0.5 degrees C. higher than the set temperature of the occupied area. Also, when the air-conditioning mode of the occupied area is heating operation and an unoccupied area is located at a distance of 15 m from the occupied area, the target temperatures of the unoccupied area is set 1.5 degrees C. lower than the set temperature of the occupied area.

The control unit 110 includes a presence/absence map creation unit 111 and a target temperature determination unit 112. Based on detection results produced by the presence sensors 11B to 19B as well as on the sensor map 121 of the storage unit 120, the presence/absence map creation unit 111 creates a presence/absence map showing a relative positional relationship between an occupied area in which somebody is present and unoccupied areas in which nobody is present. The presence/absence map contains information about distances and directions to the unoccupied areas from the occupied area.

Figure 5:
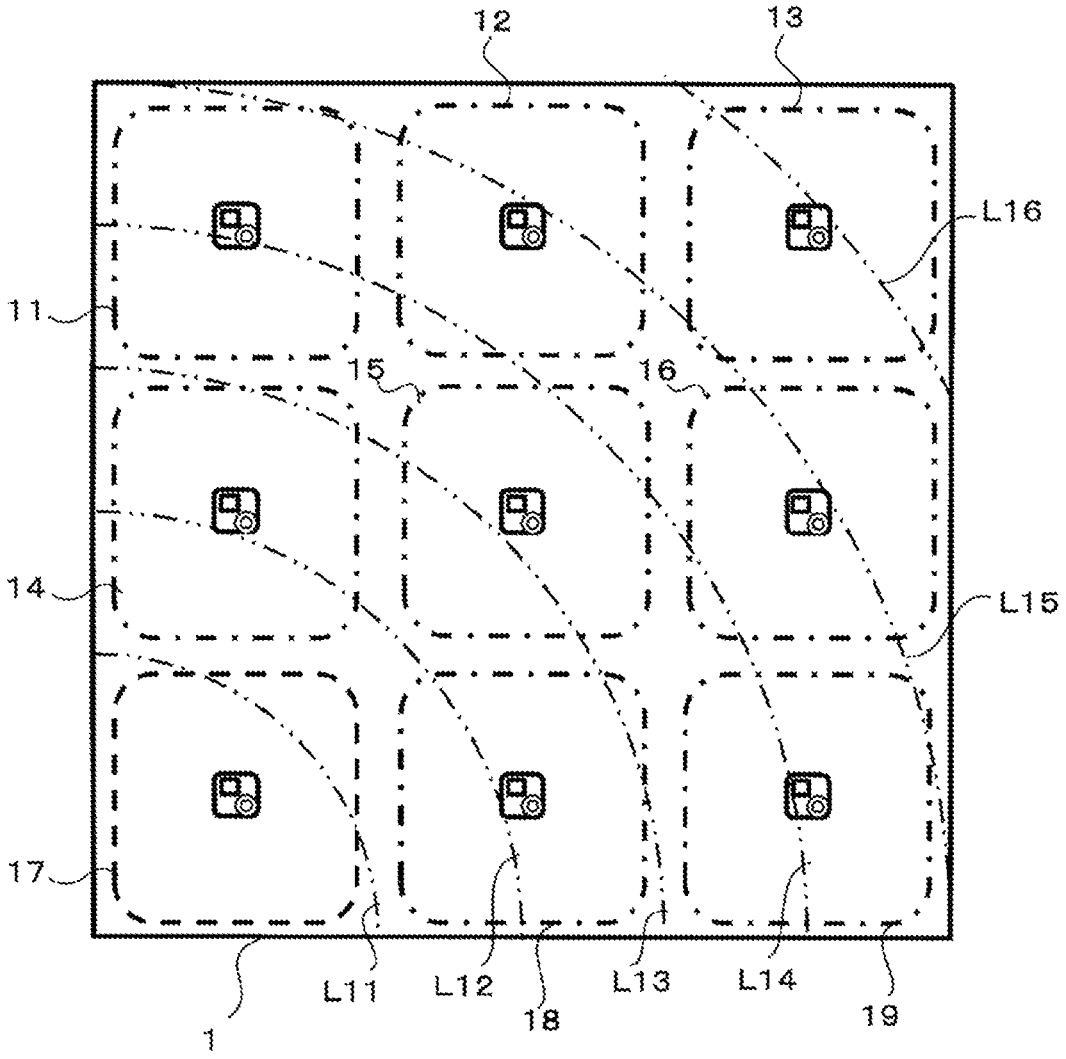
FIG. 5 is a diagram showing a distribution of target temperatures of unoccupied areas when there is one occupied area.

In the air-conditioning system 100, when the energy saving mode is on, based on the target temperature table 122 shown in FIG. 4 and the presence/absence map created by the presence/absence map creation unit 111, the target temperature determination unit 112 determines target temperatures of the occupied areas and the unoccupied areas. FIG. 5 is a diagram showing a distribution of target temperatures of unoccupied areas when there is one occupied area. In the example shown in FIG. 5, the area 17, which is indicated by a dotted line, is an occupied area, and the other areas, i.e., the areas 11 to 16, 18, and 19, which are indicated by chain lines, are unoccupied areas. In the area 17, the air-conditioning mode is cooling and the set temperature of the room temperature is 26.5 degrees C. Here, the unoccupied areas located next to the occupied area 17 are designated as adjacent areas and the unoccupied area farthest from the area 17 is designated as a distal area. The target temperature determination unit 112 determines the target temperatures of unoccupied areas such that the target temperatures will be distributed by increasing stepwise in increments of 0.5 degrees C. from the set temperature of the area 17, i.e., 26.5 degrees C. with increasing distance, from the adjacent areas toward the distal area. In the example shown in FIG. 5, the adjacent areas are the areas 14 and 18, and the distal area is the area 13. In FIG. 5, the distribution of target temperatures is indicated by chain double-dashed lines L11 to L16 in a manner similar to contour lines. Line L11 represents a target temperature of 26.0 degrees C., line L12 represents a target temperature of 26.5 degrees C., line L13 represents a target temperature of 27.0 degrees C., line L14 represents a target temperature of 27.5 degrees C., line L15 represents a target temperature of 28.0 degrees C., and line L16 represents a target temperature of 28.5 degrees C.

Figure 6:
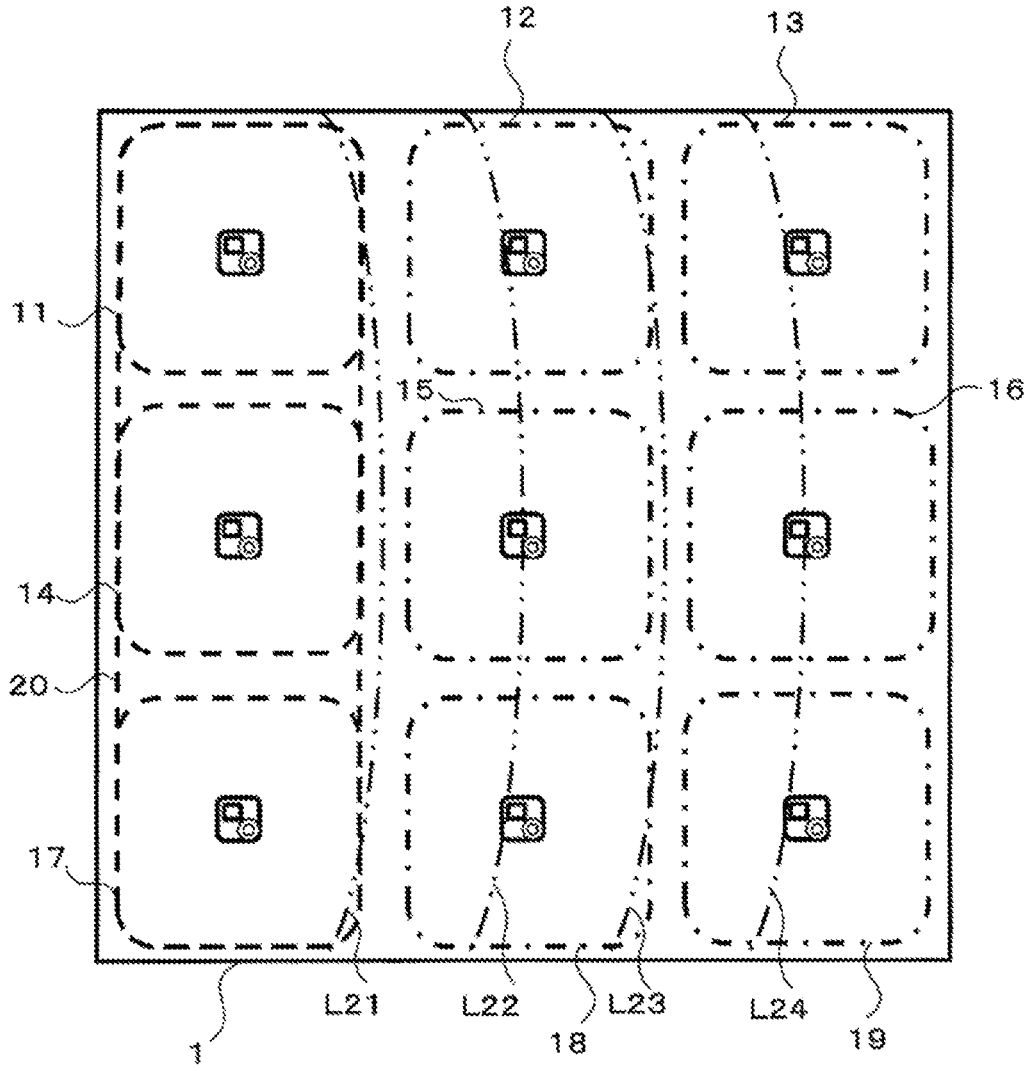
FIG. 6 is a diagram showing a distribution of target temperatures of unoccupied areas when plural occupied areas are located adjacent to one another.

FIG. 6 is a diagram showing a distribution of target temperatures of unoccupied areas when plural occupied areas are clustered together. In the example shown in FIG. 6, the areas 11, 14, and 17, which are indicated by dotted lines, are occupied areas, and the other areas, i.e., the areas 12, 13, 15, 16, 18, and 19, which are indicated by chain lines, are unoccupied areas. The areas 11 and 14 are adjacent to each other, and so are the areas 14 and 17. Here, the areas 11, 14, and 17 make up an occupied area group 20. In the areas 11, 14, and 17, the air-conditioning mode is cooling and the set temperature of the room temperature is 26.0 degrees C. The target temperature determination unit 112 determines the target temperatures of the unoccupied areas as follows. That is, the target temperatures are determined in such a way as to be distributed by increasing stepwise in increments of 0.5 degrees C. from the set temperature of the occupied area group 20, i.e., 26.0 degrees C. with increasing distance, from the adjacent areas 12, 15, and 18, toward the distal areas 13, 16, and 19. In FIG. 6, the distribution of target temperatures is indicated by chain double-dashed lines L21 to L24 in a manner similar to contour lines. Line L21 represents a target temperature of 26.0 degrees C., line L22 represents a target temperature of 26.5 degrees C., line L23 represents a target temperature of 27.0 degrees C., and line L24 represents a target temperature of 27.5 degrees C. The target temperature of the areas 12, 15, and 18 is set to 26.5 degrees C. and the target temperature of the areas 13, 16, and 19 is set to 27.5 degrees C.

Figure 7:
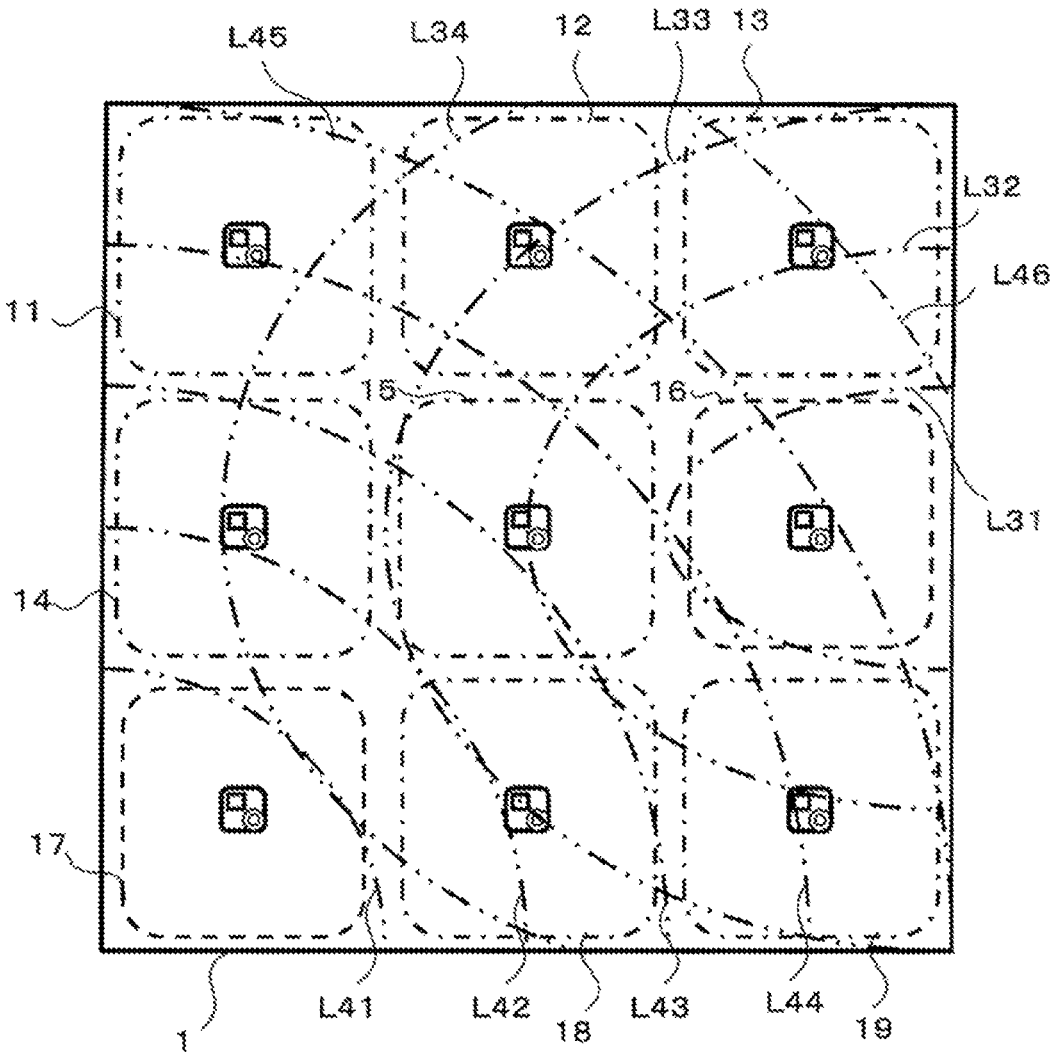
FIG. 7 is a diagram showing a distribution of target temperatures of unoccupied areas when plural occupied areas are scattered.

FIG. 7 is a diagram showing a distribution of target temperatures of unoccupied areas when plural occupied areas are scattered. In the example shown in FIG. 7, the areas 16 and 17, which are indicated by dotted lines, are occupied areas, and the other areas, i.e., the areas 11 to 13, 14, 15, 18, and 19, which are indicated by chain lines, are unoccupied areas. In the areas 16 and 17, the air-conditioning mode is cooling and the set temperature is 26.0 degrees C. The target temperature determination unit 112 determines candidate target temperatures of the unoccupied areas such that the candidate target temperatures will be distributed by increasing stepwise in increments of 0.5 degrees C. from the set temperature of 26.0 degrees C. with increasing distance, from the adjacent areas 13, 15, and 19 of the area 16 toward the distal areas 11 and 17. Similarly, candidate target temperatures of the unoccupied areas are determined in such a way as to be distributed by increasing stepwise in increments of 0.5 degrees C. from the set temperature of 26.0 degrees C. with increasing distance, from the adjacent areas 14 and 16 of the area 17 toward the distal area 13 of the area 17.

In FIG. 7, the distribution of candidate target temperatures determined with reference to the area 16 is indicated by chain double-dashed lines L31 to L34 in a manner similar to contour lines. Line L31 represents a target temperature of 26.0 degrees C., line L32 represents a target temperature of 26.5 degrees C., line L33 represents a target temperature of 27.0 degrees C., and line L34 represents a target temperature of 27.5 degrees C. Also, in FIG. 7, the distribution of candidate target temperatures determined with reference to the area 17 is indicated by chain double-dashed lines L41 to L46 in a manner similar to contour lines. Line L41 represents a target temperature of 26.0 degrees C., line L42 represents a target temperature of 26.5 degrees C., line L43 represents a target temperature of 27.0 degrees C., line L44 represents a target temperature of 27.5 degrees C., line L45 represents a target temperature of 28.0 degrees C., and line L46 represents a target temperature of 28.5 degrees C.

Since there are two occupied areas serving as references, two candidate target temperatures coexist in some unoccupied areas. In this case, according to the present Embodiment 1, regarding an unoccupied area in which plural candidate target temperatures exist, the lower temperature, i.e., the temperature that will more greatly strengthen the air-conditioning mode of the occupied area, is determined as the target temperature. For example, regarding the area 18, the candidate target temperature based on the distance from the area 16 is 27.0 degrees C. as indicated by L33 and the candidate target temperature based on the distance from the area 17 is 26.5 degrees C. as indicated by L42. In this case, the candidate target temperature of the area 18 is set to 26.5 degrees C. Also, regarding the area 15, the candidate target temperature based on the distance from the area 16 is 26.5 degrees C. as indicated by L32 and the candidate target temperature based on the distance from the area 17 is 27.0 degrees C. as indicated by L43. In this case, the candidate target temperature of the area 15 is set to 26.5 degrees C.

With reference to FIGS. 5 to 7, description has been given above of how the target temperatures of unoccupied areas are determined in the case where the air-conditioning mode of the occupied area is cooling operation. When the air-conditioning mode of the occupied area is heating operation, the target temperature determination unit 112 also determines the target temperature of each unoccupied area such that the target temperature of the unoccupied area will be distributed by decreasing stepwise with increasing distance. When the air-conditioning mode of the occupied area is heating operation, the target temperatures of the unoccupied areas are determined in such a way as to be distributed in a manner similar to contour lines by decreasing stepwise in increments of 0.5 degrees C. from the set temperature of the occupied area toward the unoccupied area farthest from the occupied area. Also, when there are plural occupied areas, regarding an unoccupied area for which plural candidate target temperatures exist, the target temperature determination unit 112 determines the higher temperature, i.e., the temperature that will more greatly strengthen the air-conditioning mode of the occupied area, as the target temperature.

Next, description will be given of a case in which there are plural occupied areas differing in air-conditioning mode. When different air-conditioning modes are set in plural occupied areas, i.e., when an occupied area set to cooling operation and an occupied area set to heating operation coexist, it is likely that plural candidate target temperatures exist in some unoccupied areas. In this case, the target temperature determination unit 112 determines the target temperature by taking an average of a candidate target temperature determined based on the distance from the occupied area whose air-conditioning mode is cooling and a candidate target temperature determined based on the distance from the occupied area whose air-conditioning mode is heating.

Once respective target temperatures of the areas 11 to 19 are determined in the manner described above, the control unit 110 controls operation of the indoor units 11A to 19A such that temperatures of the air blowing out of the indoor units 11A to 19A will conform to the target temperatures.

Figure 8:
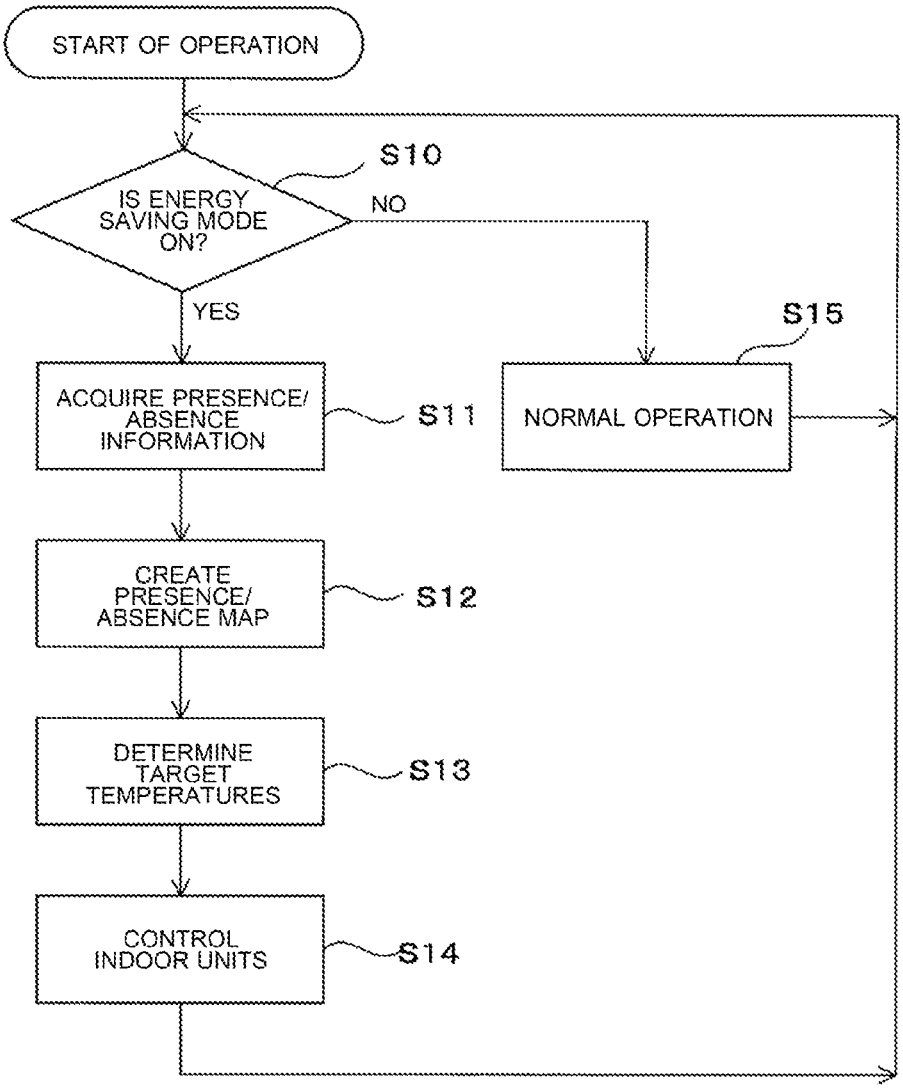
FIG. 8 is a flowchart showing procedures of zonal air-conditioning control according to Embodiment 1.

FIG. 8 is a flowchart showing procedures of zonal air-conditioning control according to Embodiment 1. A zonal air-conditioning control method of the present Embodiment 1 will be described with reference to FIG. 8. Upon starting air-conditioning control of the room 1, the controller 101 checks in step S10 whether the energy saving mode is on. Once it is confirmed that the energy saving mode is on, the process goes to step S11. Presence/absence information is acquired in step S11. Regarding the areas 11 to 19 shown in FIG. 1, based on detection results produced by the presence sensors 11B to 19B, information as to whether or not anyone is present in the respective areas 11 to 19 is acquired. Step S11 corresponds to a presence/absence information acquisition step of the present invention.

Next, the controller 101 goes to step S12 to create a presence/absence map showing a relative positional relationship between occupied areas in which somebody is present and unoccupied areas in which nobody is present. The presence/absence map is created based on the information acquired in step 11, indicating human presence/absence, and on the above-mentioned sensor map 121 stored in the storage unit 120. Step S12 corresponds to a presence/absence map creation step of the present invention.

Once the presence/absence map is created in step S12, the controller 101 goes to step S13 to determine respective target temperatures of the areas 11 to 19. Of the areas 11 to 19, regarding the occupied areas in which somebody has been detected to be present in step 11, set temperatures specified for the respective areas by the persons in the areas are determined as target temperatures. Of the areas 11 to 19, regarding the areas in which nobody has been detected to be present in step 11, target temperatures are determined based on the target temperature table 122 shown in FIG. 4 described above and the presence/absence map created in step S12. A method for determining the target temperatures of the respective areas is as described above. Step S13 corresponds to a target temperature determination step of the present invention.

Next, the controller 101 goes to step S14 to control the operation of the indoor units 11A to 19A such that the respective room temperatures of the areas 11 to 19 will conform to the target temperatures determined in step S13. Step S14 corresponds to an operation step of the present invention.

On the other hand, when it is confirmed in step S10 that the energy saving mode is not on, the controller 101 goes to step S15. In step S15, the controller 101 performs normal operation in each of the areas 11 to 19, controlling the operation of the indoor units 11A to 19A individually.

Once step S14 or step S15 is carried out, the process returns to step S10 and the processes of steps S10 to S15 described above are repeated.

Thus, according to the present Embodiment 1, when the energy saving mode is on, the target temperatures of the unoccupied areas are determined such that the air-conditioning mode of the occupied area will weaken stepwise with increasing distance from the occupied area. That is, the operating capacity of the indoor units in the unoccupied areas can be saved and the air conditioned and blown out of the indoor unit of the occupied area is prevented from being diffused as the indoor units of the unoccupied areas are stopped. Thus, energy consumption of the entire air-conditioning system 100 can be reduced while maintaining comfort of the occupied area. This allows zonal air-conditioning control to achieve both comfort and energy savings.

According to the present Embodiment 1, the target temperatures of the unoccupied areas located at equal distances from the occupied area are set equal to one another. This more effectively prevents diffusion of the air conditioned and blown out of the indoor unit of the occupied area.

According to the present Embodiment 1, when there are plural occupied areas and plural candidate target temperatures coexist in some unoccupied areas, the temperature that will more greatly strengthen the air-conditioning mode of the occupied areas is determined as the target temperature. This more effectively prevents diffusion of the air conditioned and blown out of the indoor units of the occupied areas.

According to the present Embodiment 1, when an occupied area set to cooling operation and an occupied area set to heating operation coexist and plural candidate target temperatures exist in some unoccupied areas, an average of the plural candidate target temperatures is determined as the target temperature. This makes it possible to achieve energy savings without impairing comfort of the occupied area set to cooling operation and the occupied area set to heating operation.

According to the present Embodiment 1, the target temperature table 122 is used in determining target temperatures. This makes it possible to determine the target temperatures of unoccupied areas in a stable manner.

According to the present Embodiment 1, the indoor units 11A to 19A are four-way airflow ceiling cassette indoor units, but this is not restrictive, and two-way airflow ceiling cassette indoor units or ducted indoor units may be used.

According to the present Embodiment 1, the presence sensors 11B to 19B detect human presence or absence in the areas 11 to 19, but this is not restrictive. Human presence or absence in the areas 11 to 19 may be detected based on an on/off state of personal computers or displays placed in the areas 11 to 19 or an on/off state of lighting installed in the areas 11 to 19. Alternatively, human presence or absence may be detected using security information on entry and exit into/from the areas 11 to 19.

According to the present Embodiment 1, the room temperatures of the respective areas 11 to 19 are detected by the infrared sensors 110 to 19C, but this is not restrictive. The room temperatures may be detected by temperature sensors adapted to detect temperatures of air sucked into the indoor units 11A to 19A, room temperature sensors installed in the respective areas 11 to 19 and each equipped with a built-in remote control, or remote temperature sensors.

Embodiment 2

Figure 9:
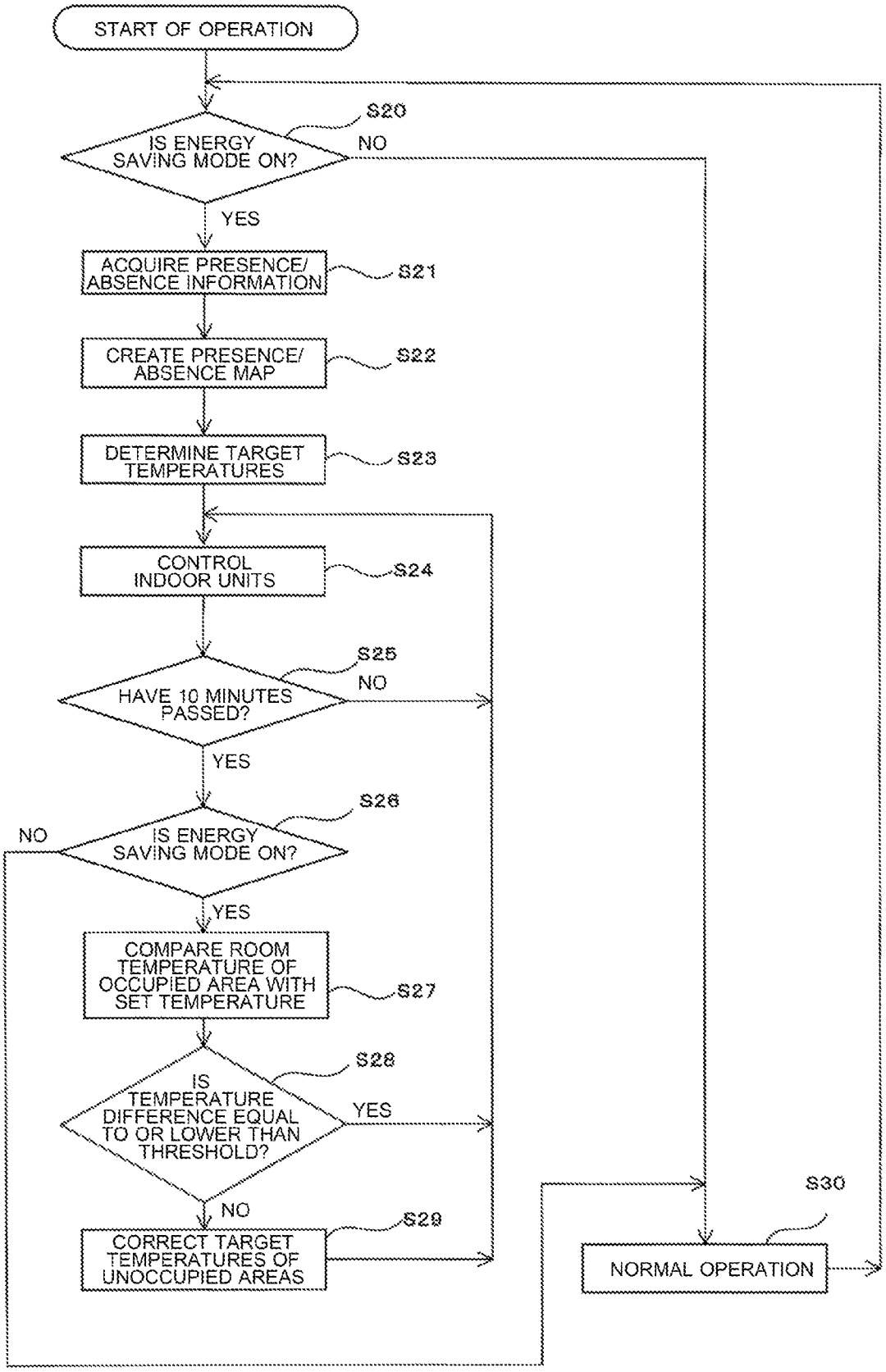
FIG. 9 is a flowchart showing procedures of zonal air control according to Embodiment 2.

FIG. 9 is a flowchart showing procedures of zonal air control according to Embodiment 2. Steps S20 to S24 are the same as steps S10 to S14 of FIG. 8, and thus description thereof will be omitted. The controller 101 controls the indoor units 11A to 19A in step S24 such that the room temperatures of the respective areas 11 to 19 will conform to the determined target temperatures, and then goes to step S25. In step S25, it is checked whether a predetermined time, e.g., 10 minutes, has passed since the control over the indoor units 11A to 19A started. If 10 minutes has not passed yet, the process of step S24 is repeated. When it is confirmed that 10 minutes has passed, the controller 101 goes to step S26. In step S26, it is checked as with step S20 whether the energy saving mode is on. When it is confirmed that the energy saving mode is on, the process goes to step S27. On the other hand, when it is confirmed that the energy saving mode is not on, the process goes to step S30. In step S30, as with step S15 described above, the controller 101 performs normal operation in each of the areas 11 to 19, controlling the operation of the indoor units 11A to 19A individually.

When the process goes to step S27, the current room temperature of the occupied area is acquired based on the detection results produced by the infrared sensors 110 to 19C and compared with the set temperature of the occupied area. Step S27 corresponds to a room temperature comparison step of the present invention. Next, in step S28, it is checked whether the difference between the current room temperature and set temperature of the occupied area is equal to or lower than a threshold. When the difference is equal to or lower than the threshold, it can be determined that diffusion of air from the occupied area to the unoccupied areas is limited, that the room temperature of the occupied area does not deviate greatly from the set temperature even if there is some fluctuations, and that comfort of the occupied area is maintained. Thus, once it is confirmed in step S28 that the difference between the current room temperature and set temperature of the occupied area is equal to or lower than the threshold, the process returns to step S24. Then, control over the indoor units of the unoccupied areas is continued based on the target temperatures determined in step S23.

In contrast, when the temperature difference between the current room temperature and set temperature of the occupied area exceeds the threshold, it can be determined that air is being diffused from the occupied area to the unoccupied areas and that comfort of the occupied area is being reduced due to fluctuations in the room temperature of the occupied area. In this case, the controller 101 goes to step S29 and corrects the target temperatures of the unoccupied areas determined in step S23 in such a way as to strengthen the air-conditioning mode of the occupied area. That is, when the air-conditioning mode of the occupied area is cooling, the target temperatures of the unoccupied areas are corrected to temperatures lower than the target temperatures determined in step S23. When the air-conditioning mode of the occupied area is heating, the target temperatures of the unoccupied areas are corrected to temperatures higher than the target temperatures determined in step S23. Once the target temperatures of the unoccupied areas are corrected in step S29, the process returns to step S24, in which the indoor units of the unoccupied areas are controlled based on the corrected target temperatures. Step S29 corresponds to a correction step of the present invention.

According to the present Embodiment 2, while the energy saving mode is active, the target temperatures of the unoccupied areas are reviewed every 10 minutes. Thus, comfort of the occupied area is maintained more effectively.

Note that although the target temperatures of the unoccupied areas are configured to be reviewed every 10 minutes in the present Embodiment 2, this is not restrictive. The time intervals at which the target temperatures of the unoccupied areas are reviewed may be set as appropriate according to the number, size, and other properties of areas in the room.

| Reference Signs List | |
|---|---|
| 1 | room |
| 11 | area |
| 11A | indoor unit |
| 12 | area |
| 12A | indoor unit |
| 12B | presence sensor |
| 12C | infrared sensor |
| 13 | area |
| 13A | indoor unit |
| 13B | presence sensor |
| 13C | infrared sensor |
| 14 | area |
| 14A | indoor unit |
| 14B | presence sensor |
| 14C | infrared sensor |
| 15 | area |
| 15A | indoor unit |
| 15B | presence sensor |
| 15C | infrared sensor |
| 16 | area |
| 16A | indoor unit |
| 16B | presence sensor |
| 16C | infrared sensor |
| 17 | area |
| 17A | indoor unit |
| 17B | presence sensor |
| 17C | infrared sensor |
| 18 | area |
| 18A | indoor unit |
| 18A | presence sensor |
| 18B | infrared sensor |
| 19 | area |
| 19A | indoor unit |
| 19B | presence sensor |
| 19C | infrared sensor |
| 20 | occupied area group |
| 100 | air-conditioning system |
| 101 | controller |
| 102 | remote controller |
| 110 | control unit |
| 111 | presence/absence map creation unit |
| 112 | target temperature determination unit |
| 120 | storage unit |
| 121 | sensor map |
| 122 | target temperature table |

The invention claimed is:

1. An air-conditioning system that divides a room to be air-conditioned into a plurality of areas and controls air-conditioning of each of the plurality of areas, the air-conditioning system comprising:

a plurality of presence/absence sensors provided in respective ones of the plurality of areas and adapted to detect whether or not anyone is present in the respective areas;

a plurality of temperature sensors provided in respective ones of the plurality of areas and adapted to detect respective room temperatures;

a plurality of indoor units provided in respective ones of the plurality of areas; and a controller adapted to control the plurality of indoor units based on detection results produced by the plurality of presence/absence sensors and detection results produced by the plurality of temperature sensors, wherein the controller is configured to create a presence/absence map showing a relative positional relationship between an occupied area in which somebody is present and unoccupied areas in which nobody is present, based on the detection results produced by the plurality of presence/absence sensors, determine target temperatures of the respective room temperatures of the occupied area and the unoccupied areas based on the presence/absence map created, and control the respective indoor units of the occupied area and the unoccupied areas such that the respective room temperatures of the occupied area and the unoccupied areas conform to the target temperatures determined, and in determining the target temperature designate a temperature set for a set air-conditioning mode as the target temperature of the occupied area, and determine the target temperatures of the unoccupied areas such that the air-conditioning mode set for the occupied area weakens stepwise from an adjacent area located next to the occupied area toward a distal area located farthest from the occupied area in the room, and when a plurality of the occupied areas exist in the room and there is any of the unoccupied areas, of which a plurality of the target temperatures is set according to respective distances from the plurality of occupied areas, select the target temperature that most strengthens the air-conditioning mode from the plurality of the target temperatures.

2. The air-conditioning system of claim 1, wherein in determining the target temperature the controller sets the target temperatures of a plurality of the unoccupied areas located at equal distances from the occupied area to a same temperature.

3. The air-conditioning system of claim 1, wherein when a plurality of the occupied areas exist in the room and the plurality of occupied areas do not coincide in the air-conditioning mode and there is any of the unoccupied areas, of which a plurality of the target temperatures is set according to respective distances from the plurality of occupied areas, the controller uses an average of the plurality of the target temperatures in determining the target temperature.

4. The air-conditioning system of claim 1, wherein:

the controller includes a target temperature table in which differences between a temperature set for the occupied area and the target temperature are defined according to distances from the occupied area such that the air-conditioning mode set for the occupied area weakens stepwise with increasing distance from the occupied area; and determines the target temperatures of the unoccupied areas by referring to the target temperature table.

5. A zonal air-conditioning control method that divides a room to be air-conditioned into a plurality of areas, allocates, in the plurality of areas, respective presence/absence sensors adapted to detect whether or not anyone is present, respective temperature sensors adapted to detect room temperatures, and respective indoor units, and controls air-conditioning of the plurality of areas based on detection results produced by the presence/absence sensors and the temperature sensors, the zonal air-conditioning control method comprising:

acquiring respective pieces of information on human presence/absence in the plurality of areas based on the detection results produced by the presence/absence sensors, creating a presence/absence map showing a relative positional relationship between an occupied area in which somebody is present and unoccupied areas in which nobody is present, based on the presence/absence information acquired and a relative positional relationship between the presence/absence sensors and the temperature sensors in the room, determining target temperatures of room temperatures of the occupied area and the unoccupied areas based on the presence/absence map created, and operating the indoor units of the occupied area and the unoccupied areas such that the room temperatures conform to the target temperatures determined, wherein in determining the target temperature, a temperature set for the occupied area is designated as the target temperature of the occupied area, the target temperatures of the unoccupied areas are determined such that an air-conditioning mode set for the occupied area weakens stepwise from an adjacent area located next to the occupied area toward a distal area located farthest from the occupied area in the room, and when a plurality of the occupied areas exist in the room and there is any of the unoccupied areas, of which a plurality of the target temperatures is set according to respective distances from the plurality of occupied areas, the target temperature that most strengthens the air-conditioning mode is selected from the plurality of the target temperatures of the unoccupied areas.

6. The zonal air-conditioning control method of claim 5, further comprising:

comparing a room temperature of the occupied area detected by the temperature sensor of the occupied area with the target temperature of the occupied area during operating the indoor units when a predetermined time elapses; and correcting the target temperatures of the unoccupied areas when a difference between the target temperature of the occupied area and the room temperature of the occupied area exceeds a threshold.

7. The zonal air-conditioning control method of claim 6, wherein when after comparing the room temperature of the occupied area detected by the temperature sensor of the occupied area with the target temperature of the occupied area it is confirmed that the difference between the target temperature and the room temperature of the occupied area is equal to or lower than the threshold, the indoor units are operated, and the room temperature of the occupied area detected by the temperature sensor of the occupied area is compared with the target temperature of the occupied area.

8. The zonal air-conditioning control method of claim 5, wherein in determining the target temperature, the target temperatures of a plurality of the unoccupied areas located at equal distances from the occupied area are set to a same temperature.

9. The zonal air-conditioning control method of claim 5, wherein in determining the target temperature, when a plurality of the occupied areas exist in the room and the plurality of occupied areas do not coincide in the air-conditioning mode and there is any of the unoccupied areas, of which a plurality of the target temperatures is set according to respective distances from the plurality of occupied areas, an average of the plurality of the target temperatures is used.

10. The zonal air-conditioning control method of claim 5, wherein in determining the target temperature, a target temperature table in which the target temperatures are defined according to distances from the occupied area such that the air-conditioning mode set for the occupied area weakens stepwise with increasing distance from the occupied area is referenced.

* * * * *